US010602806B2

(12) United States Patent
Dagostino et al.

(10) Patent No.: US 10,602,806 B2
(45) Date of Patent: Mar. 31, 2020

(54) COIL PIN THREADED FASTENER AND DUVET PIN

(71) Applicant: Primpins Inc, New York, NY (US)

(72) Inventors: Janet K. Dagostino, New York, NY (US); Justin I. Dagostino, New York, NY (US)

(73) Assignee: Primpins Inc, New York, NY (US)

( * ) Notice: Subject to any disclaimer, the term of this patent is extended or adjusted under 35 U.S.C. 154(b) by 0 days.

(21) Appl. No.: 15/944,196

(22) Filed: Apr. 3, 2018

(65) Prior Publication Data

US 2019/0298006 A1 Oct. 3, 2019

(51) Int. Cl.

| | |
|---|---|
| ***A44B 1/40*** | (2006.01) |
| ***A44B 1/30*** | (2006.01) |
| ***A44B 1/32*** | (2006.01) |
| ***A47G 9/04*** | (2006.01) |
| ***A47G 9/02*** | (2006.01) |

(52) U.S. Cl.

CPC ..... *A44B 1/32* (2013.01); *A44B 1/30* (2013.01); *A47G 9/0261* (2013.01); *A47G 9/04* (2013.01); *A47G 2009/0269* (2013.01)

(58) Field of Classification Search

CPC .... A44B 1/32; A44B 1/40; A44B 1/30; A44B 1/18; A44B 1/185; A44B 1/20; A44B 1/22; A44B 1/24; A44B 1/26; A47G 9/0261; A47G 2009/0269; A47G 9/04; Y10T 24/3668; Y10T 24/3653; Y10T 24/4693; Y10T 24/4695; Y10T 24/3649; F16B 25/0005; A47C 31/026

USPC ..... 24/67.1, 379.1, 112, 105, 109, 114.05, 24/114.7, 114.12; 403/306

See application file for complete search history.

(56) References Cited

U.S. PATENT DOCUMENTS

| | | | | |
|---|---|---|---|---|
| 196,621 | A * | 10/1877 | Barion | |
| 430,306 | A * | 6/1890 | Traub | |
| 2002/0083561 | A1* | 7/2002 | Okun | A44B 1/40 24/106 |

OTHER PUBLICATIONS

Amzson online ad for eBoot 100 Pieces Clear Heads Twist Pins Plastic Head Upholstery Pin for Slipcovers and Bedskirts https://www.amazon.com/gp/product/B01MYRV1BZ/.

* cited by examiner

*Primary Examiner* — Jack W Lavinder
(74) *Attorney, Agent, or Firm* — Lee Palmateer Law Office LLC; Lee Palmateer

(57) ABSTRACT

The present invention is directed to an improved fastening apparatus comprising a coil pin having a coil shape and a threaded pin receiver, said pin and fastener being releasably connectable by threading them together so that the coil and threads mesh. The coil pin may have a pointed end for penetrating fabric material of a duvet and duvet cover so that the fastening apparatus may secure the duvet and duvet cover together.

24 Claims, 12 Drawing Sheets

COIL PIN THREADED FASTENER AND DUVET PIN

TECHNICAL FIELD

The present invention relates to a fastening apparatus for use as a duvet pin and otherwise.

BACKGROUND OF THE INVENTION

A duvet is a bedding cover that provides warmth and style. Duvets are typically plush quilts or sacks filled with down, feathers, or synthetic fibers. A duvet cover is a removable, decorative, protective fabric shell or cover for covering a duvet, similarly to the way a pillowcase covers a pillow. One may change the look of his or her bed by changing the duvet cover, without changing the entire duvet. The duvet cover may be removed for washing.

It is important to keep the duvet cover securely attached to the duvet while in use so that the duvet does not get bunched up or otherwise displaced or rearranged within the cover. Duvet pins are currently available consumer products that are commonly used to pin duvet and duvet covers together.

Typically, duvet pins comprise a straight pin with a relatively broad head, like a large button head, and a sharp distal end. The user penetrates the pin through the fabric of the duvet and duvet cover, and the sharp end of the pin is received on the other side of the fabric by a pin receiver that receives and holds the distal end of the pin securely. The pin receiver is also relatively broad so that the fabric is held between the pin head and pin receiver. If a duvet pin becomes separated from the pin receiver under normal use, the purpose of the duvet pin is defeated and the exposed sharp point of the pin becomes a safety hazard. Many currently available duvet pins embody mechanical means for preventing separation, which means also make it difficult to intentionally disassemble the duvet pin and pin receiver from one another. For example, some currently available duvet pins require a magnetic key for disassembly, which creates even more inconvenience and is susceptible of being lost.

There is a need for a duvet pin that provides a quick, convenient, effective, more easily releasable, more reliable and safer means than a straight pin for pinning a duvet and duvet cover together.

The present invention is directed to an improved duvet pin that fulfills the foregoing needs. The present invention has broader application as a fastening apparatus for fastening objects.

SUMMARY OF THE INVENTION

In a first aspect, the present invention provides an apparatus for securing a duvet cover to a duvet, comprising: a first body; a pin extending from the first body, said pin comprising at least part of a coil; a second body configured with a protrusion for engaging the at least part of a coil whereby the first and second body may be releasably secured together by a threading motion.

In a second aspect, the present invention provides a fastening apparatus, comprising: a first part comprising a coil; a second part comprising external threads; wherein the first part and second part are releasably connectable together by threading them together so that the coil meshes with the threads.

In a third aspect, the present invention provides a fastening apparatus, comprising: a first part comprising a coil; a second part comprising internal threads; wherein the first part and second part are releasably connectable together by threading them together so that the coil meshes with the threads.

In a forth aspect, the present invention provides a fastening apparatus, comprising: a first body; a pin extending from the first body, said pin comprising at least part of a coil; and a second body comprising penetrable material configured so as to form a releasable mechanical connection with the pin upon insertion of the pin into the penetrable material.

In a fifth aspect, the present invention provides a method of connecting a first and second object through a layer of material, comprising: providing a first object comprising a coiled pin; providing a second object comprising threads; positioning the first object proximate to a first side of a layer of material; positioning the second object proximate to a second side of the layer of material in alignment across the layer with the first object; moving at least one of the pin and layer so that the end of the pin advances into the layer; and turning at least one of the first part and second part in a screwing motion so that the pin meshes with the threads so as to form a threaded connection.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

Figure 1:
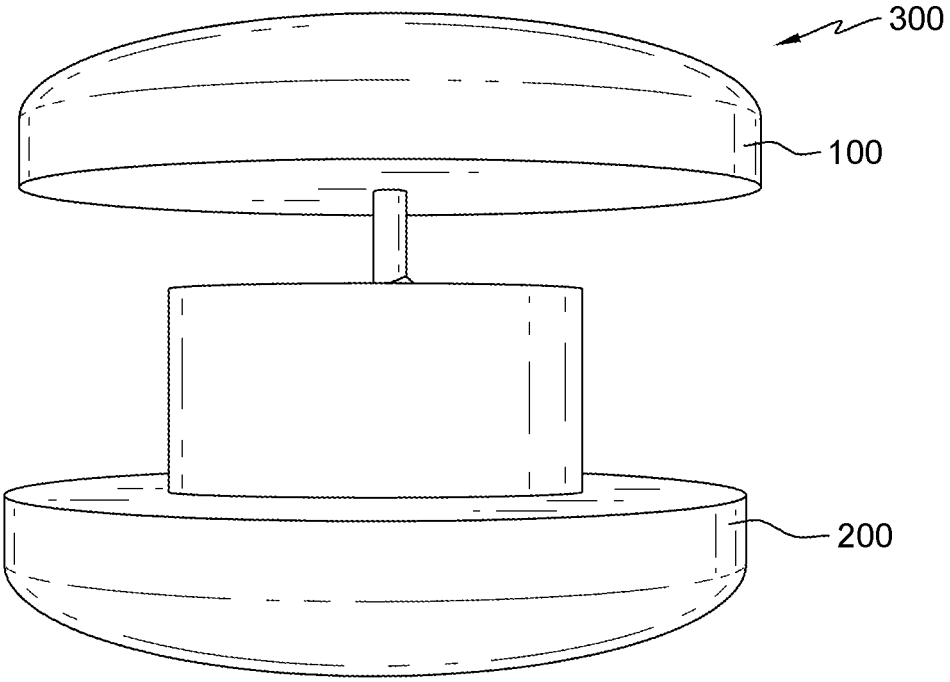
FIG. 1 is a side perspective view of a fastener assembly of the present invention.

With reference to FIG. 1, the present invention provides a duvet pin assembly 300 comprising a duvet pin 100 and a pin receiver 200. FIG. 1 shows the pin and pin receiver assembled together. In application for securing a duvet cover to a duvet, the materials of the duvet and cover may be sandwiched between the pin and pin receiver, and the pin may be penetrated through the materials.

As a convenient convention for purposes of this disclosure, directional references may assume a vertical arrangement as shown in FIGS. 1-7 with the axes of the coil and post oriented vertically as shown in said figures. However, verticality is not a limitation of the invention, and the invention may be used in any orientation, including non-vertical ones. Also as a convention for clarity in this disclosure, a forward direction with respect to the pin may be along the coil axis wherein the point of the pin is forward of the pin head. Similarly, a forward direction with respect to the pin receiver may be along the post axis wherein the distal end of the post is forward of the base.

Figure 2:
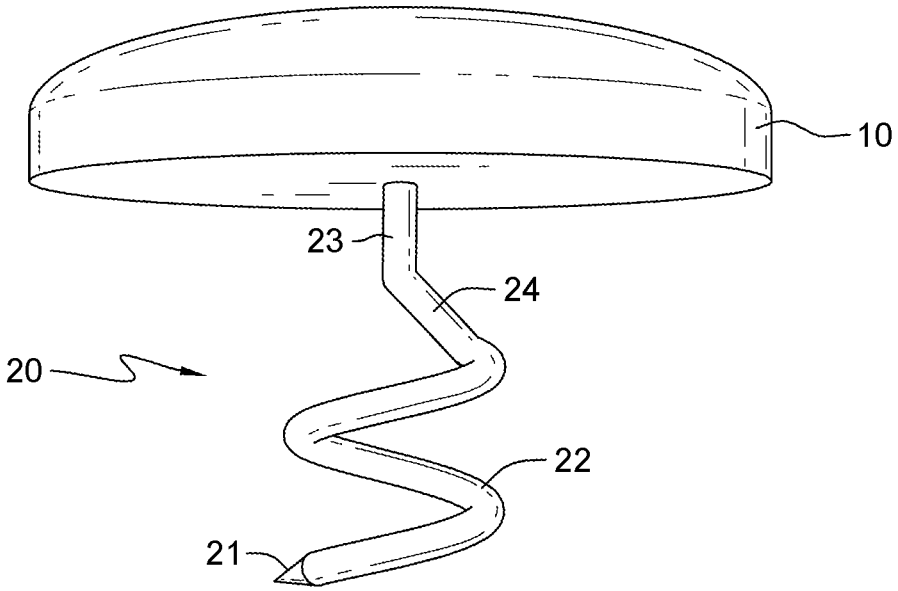
FIG. 2 is a side perspective view of a coil pin of the present invention.

With reference to FIG. 2, the duvet pin comprises a body 10 and coil pin 20 extending from the body. The coil pin comprises a point 21, coil 22, transition portion 24, and connecting portion 23. In a preferred embodiment, connecting portion 23 and transition portion 24 are straight, and transition portion 24 extends from the connecting portion 23 at an angle. In other embodiments, the connecting portion and transition portion may be curved or bent. In a preferred embodiment, pin 20 has a round cross-section, such as the round cross-section shown in FIG. 9, but in other embodiments the pin may have a differently shaped cross-section, such as oval or polygonal.

In the embodiment shown in FIGS. 2, and 7-9, coil 22 of pin 20 is coil-shaped at least until the location at its distal end where point 21 begins to taper to a point. In other embodiments, the distal end of the pin may extend in a straight line continuation from the end of coil 22 for a short distance so that it may be easier to penetrate the end of the pin through duvet material or other material. In yet another embodiment, the distal end may extend from the coil in a bent or curvilinear fashion that deviates from the coil shape so that the point may be more exposed and easier to penetrate through material.

Figure 7:
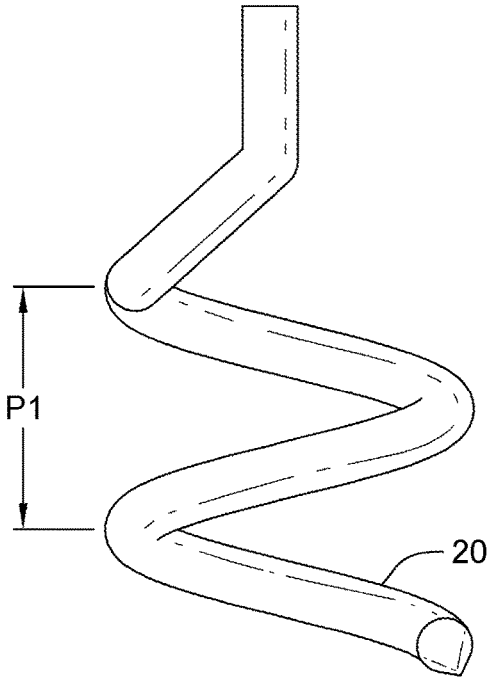
FIG. 7 is a side view of a coil pin of the present invention.
Figure 8:
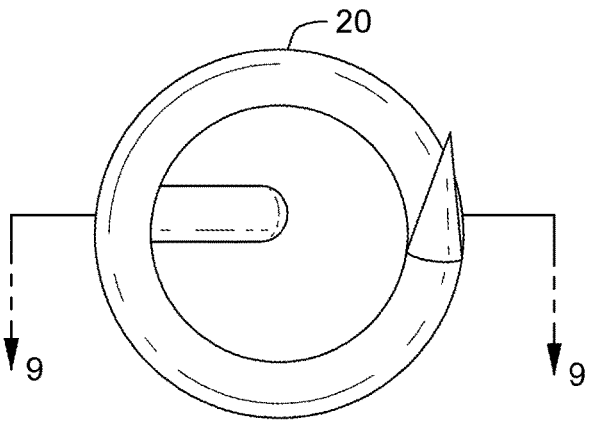
FIG. 8 is a bottom view of FIG. 7.
Figure 9:
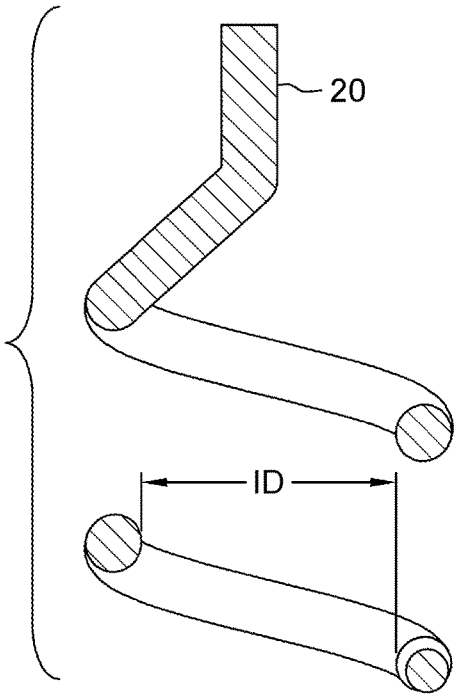
FIG. 9 is a cross sectional view of the coil pin of FIG. 8 at a plane through line "9-9".

With reference to FIG. 7, the coil has a "pitch" represented as "P1" on FIG. 7, which is defined for the purposes of this disclosure as the height of one complete turn of the coil, measured parallel to the axis of the coil. In embodiments that comprise a coil having less than one complete turn, pitch defines the helix angle of a helical coil, i.e., the angle between the coil helix and a line parallel to the coil diameter axis that runs longitudinally through the center of the coil inside diameter. With reference to FIG. 9, the coil has an inside diameter represented as "ID" on FIG. 9.

Figure 3:
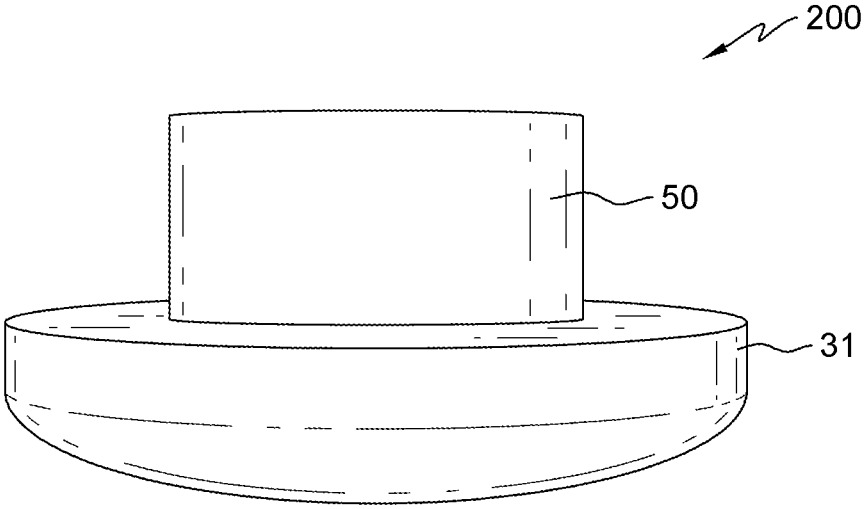
FIG. 3 is a side perspective view of a pin receiver of the present invention.
Figure 4:
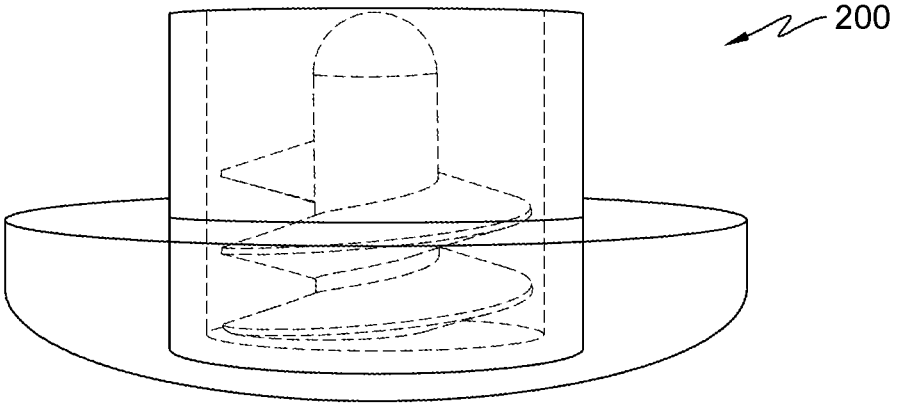
FIG. 4 is the same as FIG. 3. with the addition of dashed lines showing hidden features.
Figure 5:
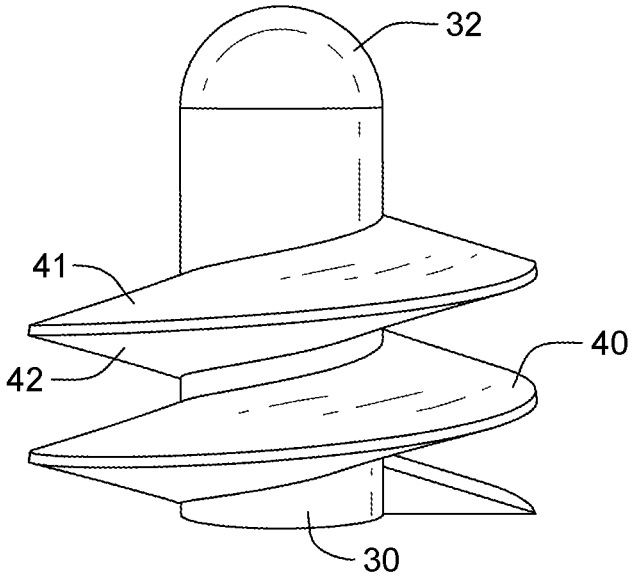
FIG. 5 is a side perspective view of a threaded post of a pin receiver of the present invention.

With reference to FIGS. 3-5, pin receiver 200 comprises a post 30. The post comprises a base 31, a distal portion 32, and a lateral protrusion 40. The lateral protrusion comprises a top side 41 and a bottom side 42. In the preferred embodiment shown in FIGS. 3-5, lateral protrusion 40 comprises screw threads 40. The pin receiver may comprise walled enclosure 50 surrounding the post and threads, which enclosure may extend from the base sufficiently far so as to extend to or past the distal end of the post. Enclosure 50 may extend any desired distance, for example less than as far as distal end of the post so as to leave part of the post exposed.

In alternate embodiments, lateral protrusion 40 may be so configured as to form grooves, such as square grooves instead of V-shaped thread interstices.

Figure 6:
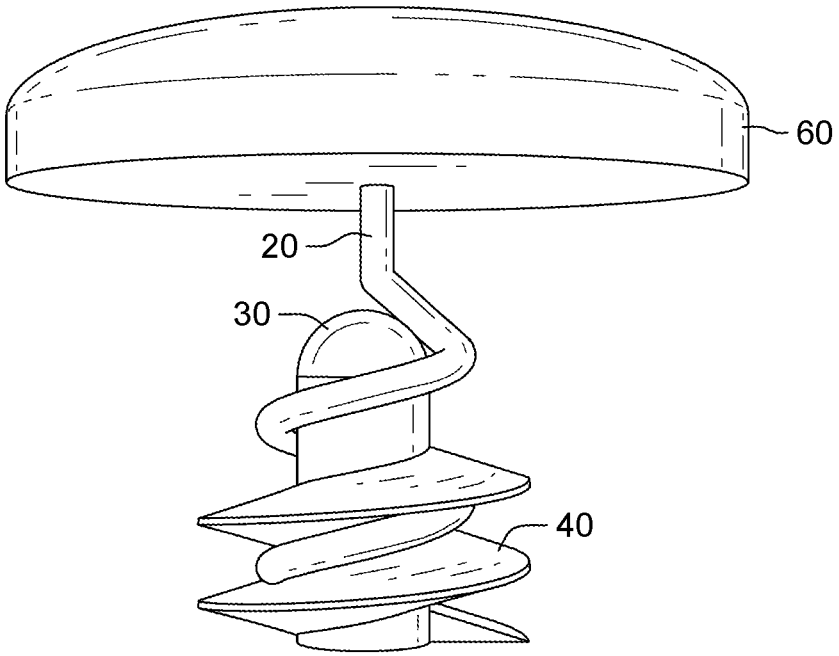
FIG. 6 is a side perspective view of a pin and post of the present invention threaded together.
Figure 11:
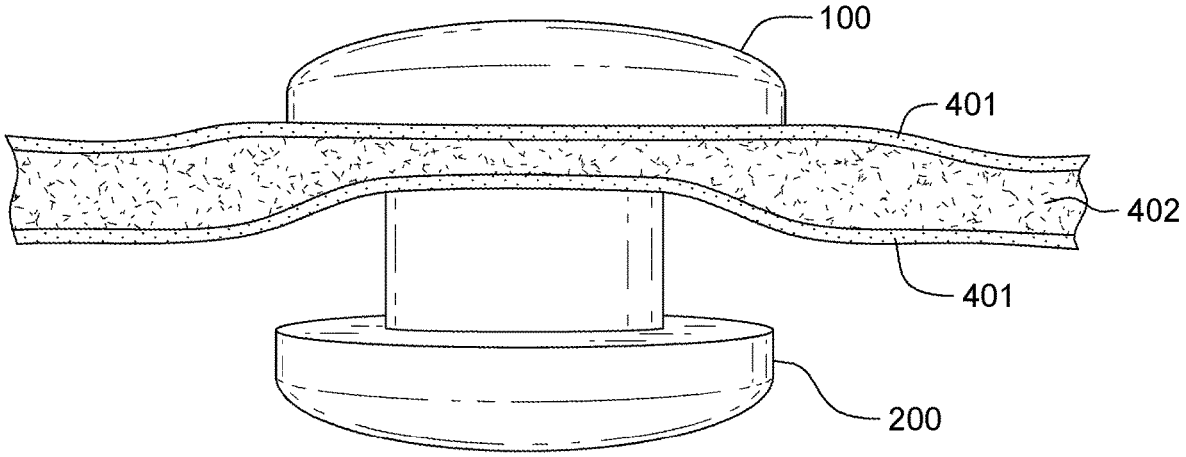
FIG. 11 is a partial cutaway side perspective view of a fastener assembly of the present invention shown in use to secure a duvet to a duvet cover.

With reference to FIGS. 1, 4 and 6, in a preferred embodiment, the pin and pin receiver may be releasably assembled to form a releasable mechanical connection by threading them together in a screwing motion so that the coil of the pin and threads of the post are meshed as shown in FIG. 6. When threaded together, the pin and pin receiver are securely connected so as to remain connected under any mechanical loading that may be anticipated in their intended application, unless and until they are intentionally disassembled by unthreading in a screwing motion. Thus, with reference to FIG. 11, by penetrating the pin through duvet cover 401 and duvet 402 and assembling the pin and pin receiver together as just described, the duvet pin assembly securely holds the articles together as shown in FIG. 11.

Figure 10:
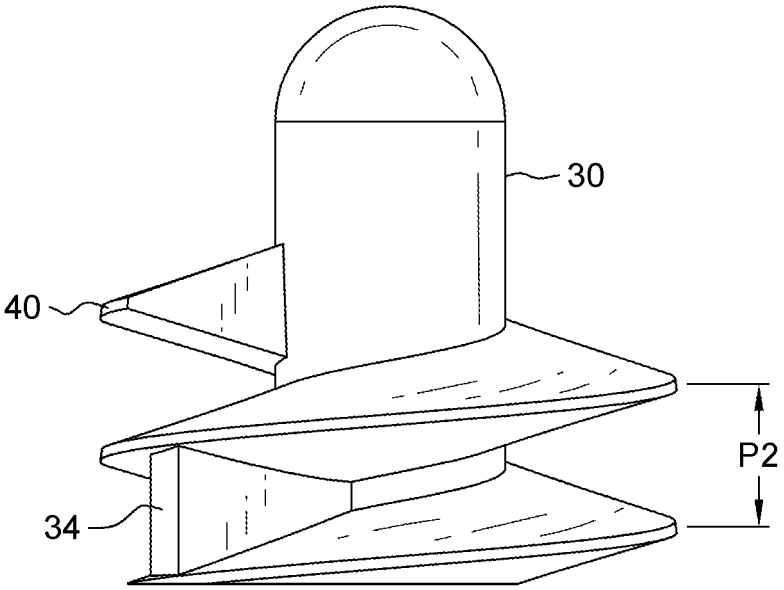
FIG. 10 is a side perspective view of another embodiment of a threaded post of a pin receiver of the present invention.

With reference to FIG. 10, threads 40 have a "pitch" represented as "P2" on FIG. 10, which is defined for the purposes of this disclosure as the height of one complete turn of the threads, measured parallel to the axis of the threads, i.e., parallel to the axis of the post. In embodiments that comprise threads having less than one complete turn, pitch defines the helix angle of the threads, i.e., the angle between the thread helix and a line parallel to the axis of the post. In a preferred embodiment, thread pitch P2 and coil pitch P1 are the same. In another embodiment, thread pitch and coil pitch are different so that, upon threading the pin and pin receiver together, the pitch mismatch causes the coil and threads to interfere with each other and impart a force on one another normal to their respective surfaces of mutual contact. The force causes the coil to elastically deflect into conformity with the thread surface. The normal force causes friction force, which provides for a more secure connection by resisting unintended unthreading that may be caused by various external forces imposed on the duvet pin assembly in normal application on a duvet. Upon intentional unthreading, the pin elastically returns to its original shape.

Figure 12A:
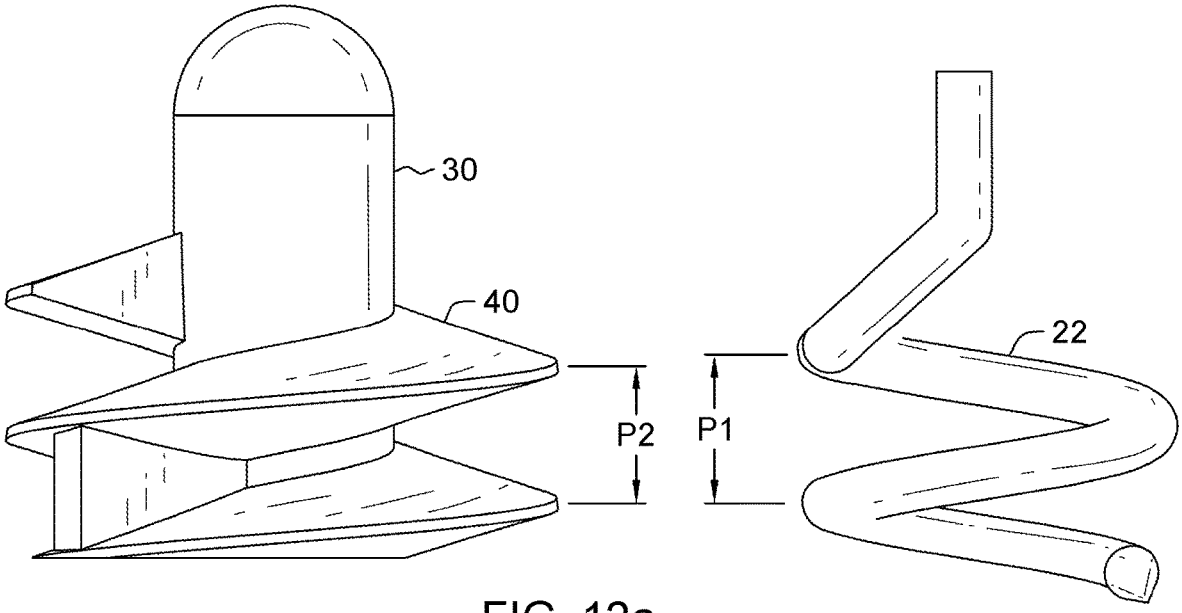
FIG. 12*a* is a threaded post of the present invention side-by-side with a coil pin of the present invention where the pitch of the post threads is slightly smaller than the pitch of the coil.
Figure 12B:
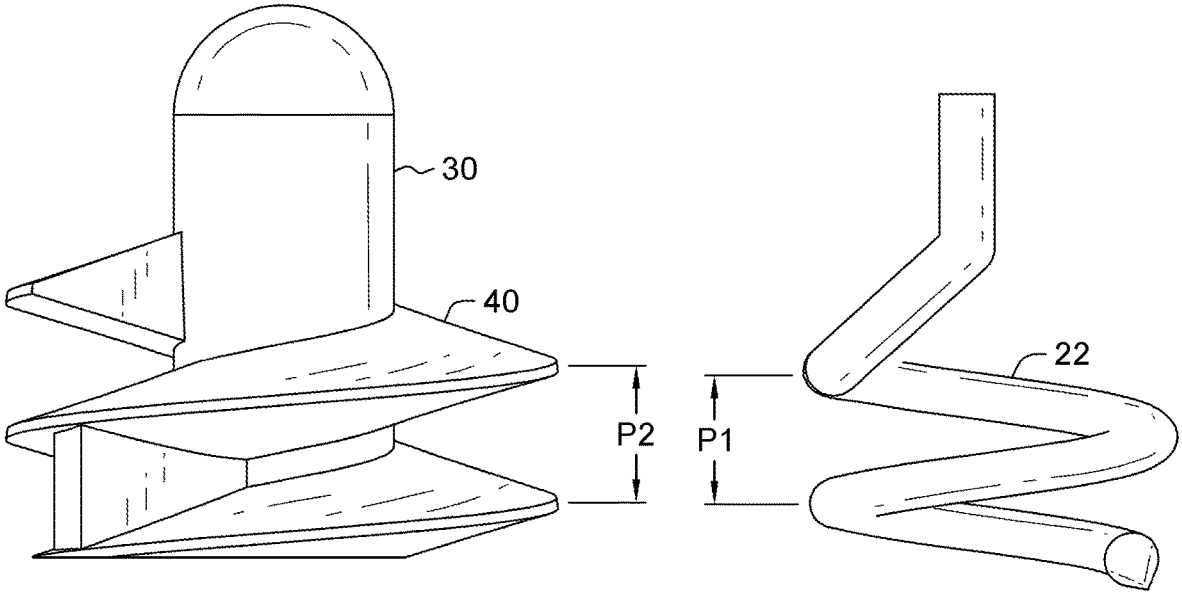
FIG. 12*b* is a threaded post of the present invention side-by-side with a coil pin of the present invention where the pitch of the post threads is slightly larger than the pitch of the coil.

With reference to FIG. 12*a*, in a preferred embodiment, the coil pitch is greater than the thread pitch so that the coil elastically deflects in compression into a smaller pitch. With reference to FIG. 12*b*, in another embodiment, the coil pitch is less than the thread pitch so that the coil elastically deflects in tension into a larger pitch. In other embodiments, the coil may have an irregular shape so that the irregularity causes interference with the threads, such as, for example including a straight section at the distal end or at some other portion of the pin.

In a preferred embodiment, the coil diameter is sized so as to have a flush fit or clearance fit with the pin receiver. In other embodiments, the coil diameter is sized to have an interference fit with the pin receiver so that, upon threading the pin and receiver together, the coil and pin receiver interfere and impart normal force on their respective surfaces of mutual contact. The force causes the coil to elastically deflect into a larger diameter and cause friction forces that provide for a more secure mechanical connection by resisting unintended unthreading that may be caused by external forces that may be experienced during normal use on a duvet. Upon intentional unthreading, the pin coil elastically returns to its original diameter.

Alternatively, the foregoing diametrical mismatch may be achieved by providing an irregular shape to the coil or pin receiver, such as, for example by providing a radial bulge or protrusion to the pin receiver post, providing a protrusion on the threads, or providing a straight section on the coil.

Figure 13A:
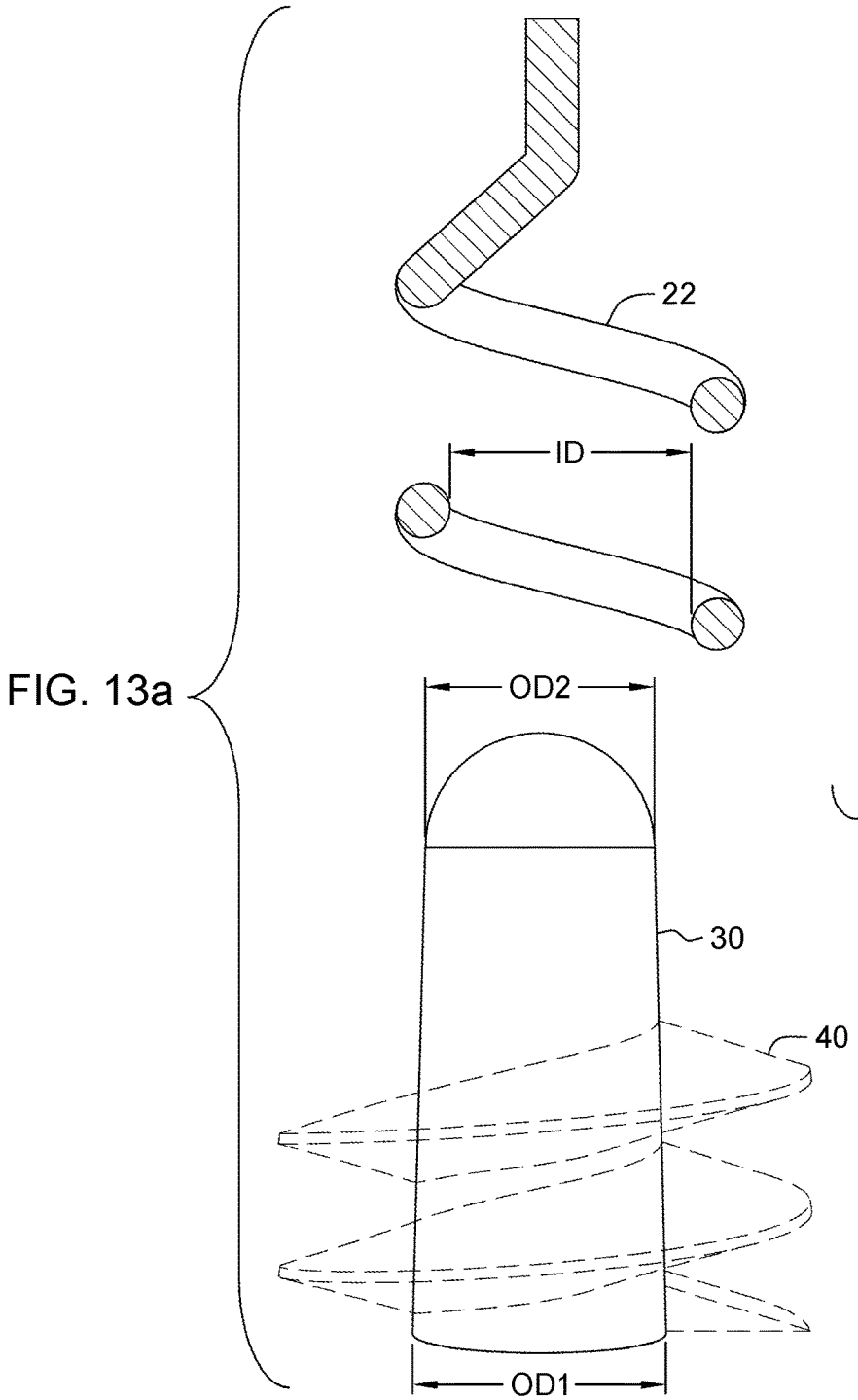
FIG. 13*a* is an exploded assembly view of a coil of FIG. 9 and a tapered post of the present invention.
Figure 13B:
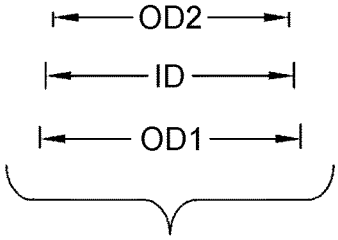
FIG. 13*b* illustrates that the outside diameter of the post tapers from a clearance fit to an interference fit with the inside diameter of the coil.

With reference to FIGS. 13*a* and 13*b*, alternatively, diametrical mismatch may be achieved by providing a tapered post that tapers in width for at least a part of its length so that the distal end of the post is sized to have a radial clearance fit with the coil of the pin, and at least part of the post is sized to have a radial interference fit with the coil. For example, the base of a round post may have a first diameter OD1 and the distal end of the post may have a second diameter OD2 that is smaller than the first diameter. The post diameter may taper from the first to the second diameter. The post may have a clearance fit with the coil at the distal end and an interference fit with the coil at positions between the distal end and the base. As the post diameter transitions wider, the interference, normal force, and friction force between the post and pin all increase as one continues to thread the pin and post together. FIG. 13*b* illustrates radial clearance fit where post outside diameter OD2 is smaller than coil inside diameter ID and radial interference fit where post outside diameter OD1 is larger than coil inside diameter ID. The pin and post may be so sized and shaped that threading may proceed to a fully threaded state where further threading is mechanically limited by the interference.

Figure 15:
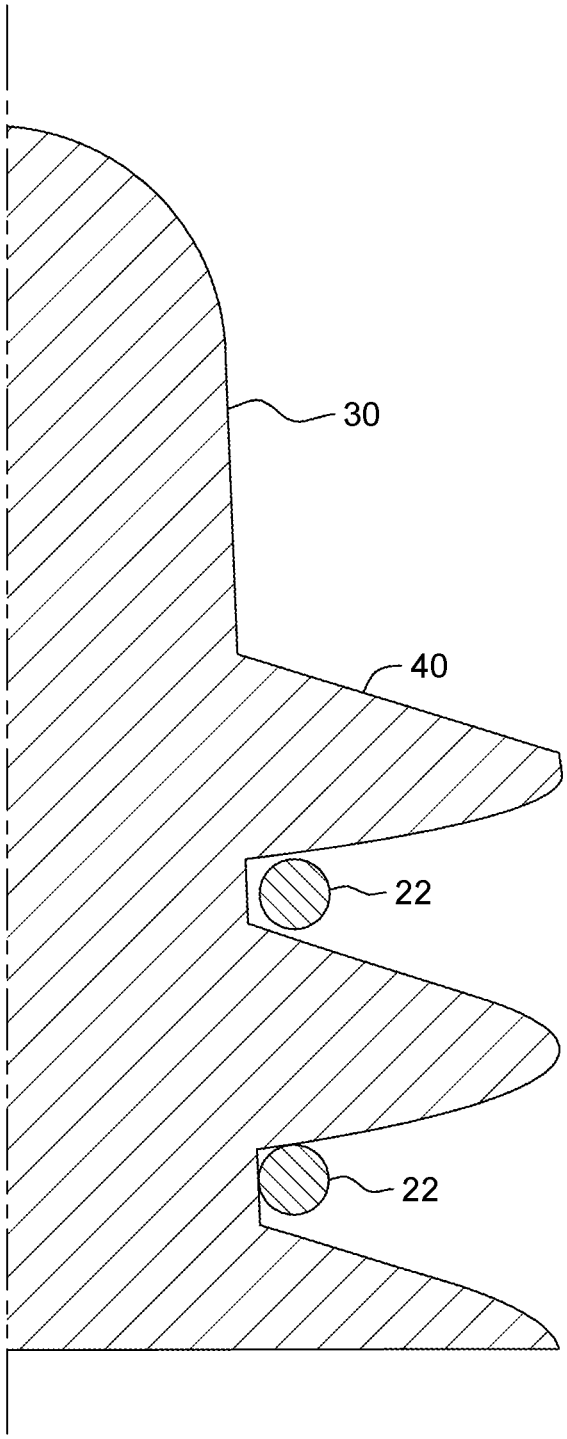
FIG. 15 is a cross-sectional view of part of a fastener assembly of the present invention with a tapered post and v-shaped threads.
Figure 16:
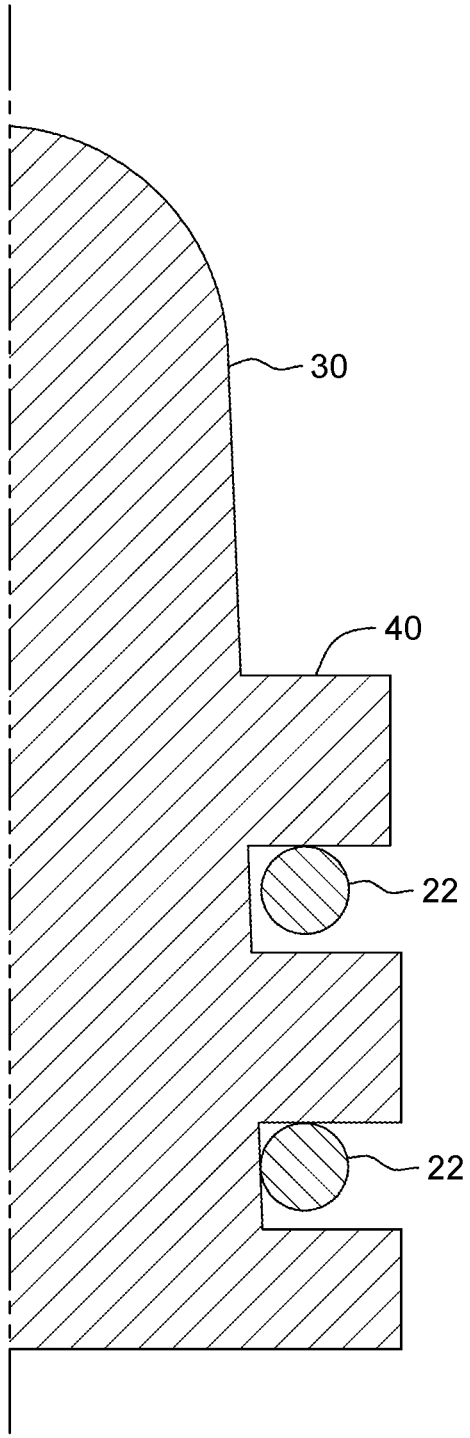
FIG. 16 is a cross-sectional view of part of a fastener assembly of the present invention with a tapered post and squared threads.

With reference to FIGS. 15 and 16, in an embodiment of the present invention having a tapered post and coil with a uniform inside diameter, the receiver and coil may have a clearance fit at an upper elevation where the post outside diameter is smaller than the coil inside diameter and an interference fit at a lower elevation where the post outside diameter becomes larger than the coil inside diameter. FIG. 15 shows an embodiment in which the pin receiver has v-shaped threads, and FIG. 16 shows an embodiment with squared threads. With v-shaped threads, interference having radial component may occur between the thread surface and the coil.

Although above disclosure of embodiments of the invention disclose elastic deflection of the pin, in other embodiments the pin receiver may elastically deflect as well. Pin receiver materials may be chosen of materials that have desired strength and elasticity, and the pin receiver may be so configured to achieve desired elastic deflection under anticipated loads.

In other embodiments, either with a tapered or untapered post, the post may comprise an protrusion 34 (see FIG. 10) interstitial of the threads that bluntly interferes with the end of the pin so as to stop the pin from further movement relative to the pin receiver, thereby providing an abrupt mechanical limitation to further threading and thereby defining the point of full assembly.

With reference to FIGS. 2, 5 and 6, pin 20 may be configured so that transition portion 24 interferes with the distal portion 32 (see FIG. 5) of post 30. The interference may provide a mechanical stop to any further threading, so that the user knows when assembly is complete. This may prevent unintentional over-threading that could cause damage to the pin or pin receiver.

With further reference to FIGS. 2 and 6, interference between pin transition portion 24 and post 30 may provide friction force for securing the connection in a manner similar to that described above with respect to pitch mismatch and/or diameter mismatch between the pin and pin receiver.

In alternate embodiments, lateral protrusion 40 may comprise any protrusion capable of engaging coil 22 of coil pin 20 so that, upon screwing motion the protrusion may engage the coil and propagate the pin forward toward the base of the post, and on an unscrewing motion may engage the coil and propagate the pin away from the base of the post. For example, the protrusion may comprise a laterally extending round peg, square peg or other shaped peg. As another example, the protrusion may comprise a slanted surface for engaging the coil.

The fastening apparatus of the present invention has broad application. The embodiments shown in FIGS. 1-11, are particularly suitable for use with fabric material and for use to secure two or more fabric articles together. Said embodiments are also particularly suitable for use as decorative items on articles comprising fabric such as clothing, duvets, pillowcases, other bedding material, curtains, furniture, and any other fabric-containing article. The head of the pin and pin receiver may comprise decorative features for any or all applications, as desired. The present invention provides any fastening apparatus embodying the features disclosed herein, for example a fastening apparatus for forming a joint between the apparatus and one or more solid objects, such as to hold two or more machine parts together. Material and dimensional variations may be selected as desired to achieve the desired mechanical performance characteristics of the fastener, such as larger sizes to handle larger mechanical loads and different materials, such as metal materials, to provide desired strength and elasticity.

For objects that cannot be readily penetrated by a pin, such as metal objects, the present invention would have application where the objects are provided with a through hole in a similar fashion that a through hole would be provided for a bolt or other threaded fastener. Particular advantages of a fastener of the present invention are that (a) the threads and post of the present invention may be disposed entirely within the thickness of the through hole, i.e., they would not be exposed outside the thickness of the objects such as the end of a bolt would be exposed in a typical nut and bolt joint, while at the same time (b) none of the objects need to be threaded such as an object may need to be threaded to receive a typical threaded fastener where no separate nut is provided. In one embodiment of the present invention, the pin receiver may be a traditional threaded fastener and the coil pin may be sized and shaped to mesh compatibly with the threads of the threaded fastener. As applied to form a joint between parts having through holes, the through holes may be sealed on one side by the head of the pin receiver and on the other side by the pinhead.

Figure 14A:
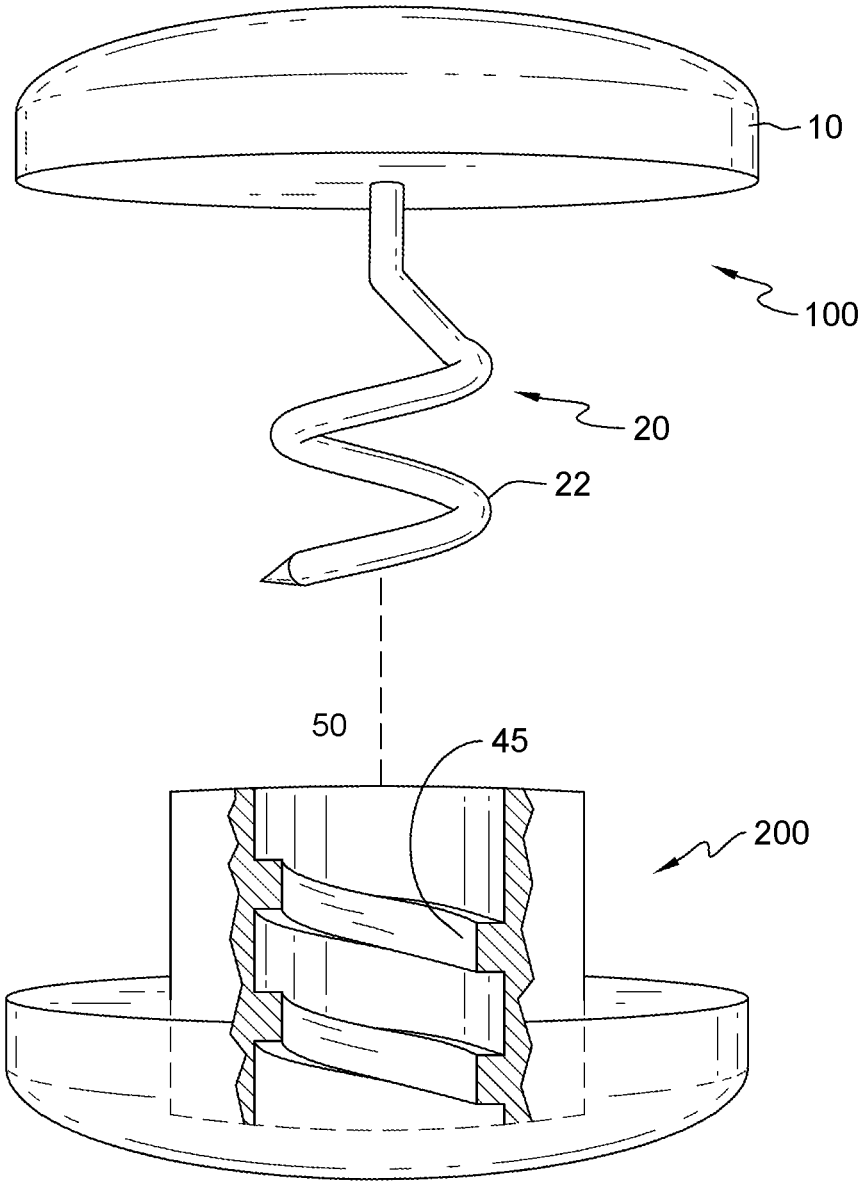
FIG. 14*a* is an exploded view of a fastener assembly of the present invention in which the pin receiver has internal squared threads shown in partial cut-away.
Figure 14B:
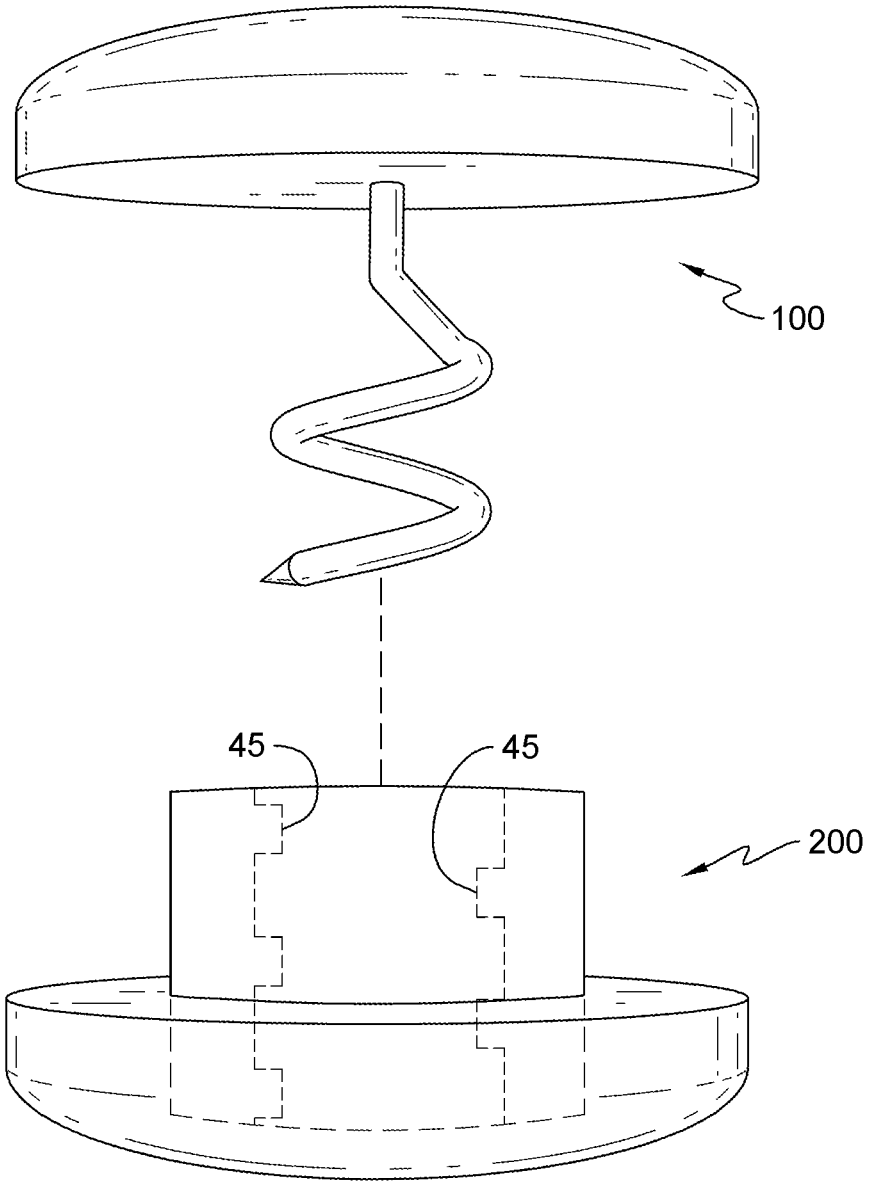
FIG. 14*b* is an exploded view of the fastener assembly of FIG. 14*a* with the internal squared threads profile shown in phantom.

With reference to FIGS. 14*a* and 14*b*, in an alternate embodiment of the present invention, the pin receiver 200 may be a female receiver having an inwardly protruding protrusion 45 for engaging the coil of the coil pin. A preferred embodiment of a female pin receiver comprises a body with female threads 45 (i.e., internal threads 45) for engaging the coil pin in similar fashion as a nut engages bolt threads. Various embodiments of the female pin receiver may comprise the same means described above for creating friction force between the coil pin and receiver, such as diametrical mismatch, pitch mismatch, protrusions interstitial of the threads, and various geometric irregularities.

In another alternate embodiment of the present invention, the pin receiver may comprise a body of penetrable material that may be penetrated by the pin so that penetration of the pin into the body of material secures the pin in the body of material. For example, the body of material may comprise cork or other material soft enough so as to be capable of penetration by a pin while sturdy enough to hold its own form. For another example, the body of material may comprise a fabric casing stuffed with stuffing, which stuffing may comprise, for example, pieces of fabric, steel wool, natural fibrous material (such as sawdust, cotton, wool, husk or ground walnut shells), plastic, or plastic beads. In such embodiments, the pin penetrates into the body of material and forms a releasable mechanical bond with the material. The pin and pin receiver thus form a releasable mechanical connection. The pin may be penetrated into the material by a screwing motion and removed from the material by an unscrewing motion, and such assembly and disassembly may be repeated as necessary, for example assembled to hold together a duvet and duvet cover and disassembled to remove the duvet cover for washing. The material may be configured with sufficient length, width, depth and volume of material to receive the coil or part thereof.

While the invention has been particularly shown and described with reference to certain embodiments, it will be understood by those skilled in the art that various changes in form and details may be made to the invention without departing from the spirit and scope of the invention as described in the following claims.

We claim:

1. An apparatus for securing a duvet cover to a duvet, comprising:

a first body;

a pin extending from the first body, said pin comprising at least part of a coil having elasticity;

a longitudinally extending second body comprising a proximal end and a distal end; and a protrusion protruding sidewise from said second body between said proximal end and said distal end for engaging the at least part of a coil whereby the first and second body may be releasably secured together by a threading motion.

2. The apparatus of claim 1, wherein the second body comprises:

a base;

an extension extending from the base, said extension having a proximal portion adjacent to the base and a distal portion away from the base; and wherein the protrusion protrudes sideways from the extension for engaging the pin so that the protrusion forces the pin to translate forward when the pin is rotated in a threading motion; and wherein at least part of the the protrusion is disposed between the proximal portion and distal portion.

3. The apparatus of claim 2 wherein the sideways protrusion consists of screw threads.

4. The apparatus of claim 2, wherein:

the distal portion of the second body is configured to receive said at least part of a coil with a radial clearance fit; and another portion of the second body is configured to receive said at least part of a coil with a radial interference fit.

5. The apparatus of claim 2, wherein:

the second body tapers in width for at least a part of its length so that the distal portion is sized to have a radial clearance fit with said at least part of a coil, and at least part of the second body is sized to have a radial interference fit with said at least part of a coil.

6. The apparatus of claim 2 wherein the second body further comprises a walled enclosure around the extension.

7. The apparatus of claim 2 wherein the protrusion comprises a slanted surface.

8. The apparatus of claim 7 wherein the slanted surface extends at least partly around the second body.

9. The apparatus of claim 8 wherein the slanted surface comprises a helical surface extending at least partly around the second body.

10. The apparatus of claim 7, wherein a pitch of the slanted surface is different than a pitch of said at least part of a coil so as to cause an interference fit between the slanted surface and said at least part of a coil in an axial direction.

11. The apparatus of claim 7, wherein a pitch of the slanted surface is greater than a pitch of said at least part of a coil so as to cause an interference fit between the slanted surface and said at least part of a coil in an axial direction.

12. The apparatus of claim 7, wherein a pitch of the slanted surface is less than a pitch of said at least part of a coil so as to cause an interference fit between the slanted surface and said at least part of a coil in an axial direction.

13. The apparatus of claim 1, wherein the second body comprises:

an opening for receiving the pin, said opening defined by at least one internally facing side;

wherein the protrusion protrudes sideways from the at least one internally facing side, said protrusion for engaging the pin so that the protrusion forces the pin to translate forward when the pin is rotated in a threading motion.

14. The apparatus of claim 13, wherein the protrusion consists of internal threads.

15. A fastening apparatus, comprising:

a first part comprising a coil having elasticity, said coil having a coil axis and an interior space along the axis;

a second part comprising a longitudinally extending body and external threads disposed around the body;

wherein the first part and second part are releasably connectable together by threading them together so that the coil meshes with the threads and so that the body is disposed in said interior space of the coil.

16. The fastening apparatus of claim 15 wherein a pitch of the coil is different than a pitch of the threads.

17. The fastening apparatus of claim 15 wherein a pitch of the coil is less than a pitch of the threads.

18. The fastening apparatus of claim 15 wherein a pitch of the coil is greater than a pitch of the threads.

19. The fastening apparatus of claim 15 wherein at least a portion of the longitudinally extending body is configured to receive said coil with a radial interference fit.

20. The fastening apparatus of claim 15 wherein the second part further comprises a walled enclosure around the external threads.

21. A fastening apparatus, comprising:

a first part comprising a coil;

a second part comprising an opening for receiving the coil, said opening defined by at least one internally facing side; and internal threads protruding from said internally facing side;

wherein the first part and second part are releasably connectable together by threading them together so that the coil meshes with the threads.

22. A fastening apparatus, comprising:

a first body;

a pin extending from the first body, said pin comprising at least part of a coil;

a second body comprising a head with a penetrable material extending therefrom configured to receive the pin into but not through the body, so as to form a releasable mechanical connection with the pin upon insertion of the pin into the penetrable material.

23. A method of connecting a first and second object through a layer of material, comprising:

providing a first object comprising a coiled pin;

providing a second object comprising screw threads selected from a group consisting of external threads and internal threads;

positioning the first object proximate to a first side of the layer of material;

positioning the second object proximate to a second side of the layer of material in alignment across the layer with the first object;

moving at least one of the pin and layer so that the end of the pin advances into the layer; and turning at least one of the first part and second part in a screwing motion so that the pin meshes with the threads so as to form a threaded connection.

24. The method of claim 23 wherein:

the step of positioning the first object proximate to a first side of the layer of material comprises positioning the first object proximate to an opening through the first side of a layer;

the step of moving at least one of the pin and layer comprises moving at least one of the pin and layer so that the end of the pin advances through the opening.

* * * * *